United States Patent [19]

Kerr et al.

[11] Patent Number: 4,829,287

[45] Date of Patent: May 9, 1989

[54] TAUT WIRE INTRUSION DETECTION SYSTEM

[75] Inventors: Reginald J. Kerr, Surrey; Tapio Suo-Anttila, Coquitlam, both of Canada

[73] Assignee: Hitek-Proteck Systems Incorporated, Canada

[21] Appl. No.: 90,953

[22] Filed: Aug. 28, 1987

Related U.S. Application Data

[63] Continuation-in-part of Ser. No. 22,294, Mar. 3, 1987.

[51] Int. Cl.[4] ..... G08B 13/12

[52] U.S. Cl. ..... 340/541; 340/550; 340/548

[58] Field of Search ..... 340/550, 541, 548, 524; 338/2

[56] References Cited

U.S. PATENT DOCUMENTS

| | | | |
|---|---|---|---|
| 2,345,771 | 4/1944 | Reynolds . | |
| 3,234,787 | 2/1966 | Ruge | 338/2 |
| 3,534,356 | 10/1970 | Bagno | 340/272 |
| 3,634,638 | 1/1972 | Savvon et al. | 200/61.93 |
| 3,841,150 | 10/1974 | Pearson . | |
| 3,912,893 | 10/1975 | Stoler | 200/61.93 |
| 3,932,718 | 1/1976 | Porat | 200/61.93 |
| 3,956,927 | 5/1976 | Pearson . | |
| 4,047,144 | 9/1977 | Wong | 338/2 |
| 4,190,796 | 2/1980 | Ishii | 323/75 N |
| 4,206,450 | 6/1980 | Harden et al. | 340/541 |
| 4,213,348 | 7/1980 | Reinertson | 73/765 |
| 4,240,288 | 12/1980 | D'Antonio et al. | 73/862.68 X |
| 4,327,593 | 5/1982 | Porat | 73/862.68 |
| 4,367,459 | 1/1983 | Amir et al. | 340/541 |
| 4,500,864 | 2/1985 | Nakane | 338/4 |
| 4,500,873 | 2/1985 | Porat et al. | 340/515 |
| 4,527,150 | 7/1985 | Porat | 340/541 |
| 4,533,906 | 8/1985 | Amir | 340/541 |
| 4,613,848 | 9/1986 | Watkins | 340/524 |

FOREIGN PATENT DOCUMENTS

| | | | |
|---|---|---|---|
| 967259 | 5/1975 | Canada | 338/2 |
| 3131431 | 2/1983 | Fed. Rep. of Germany | 73/766 |
| 113850 | 9/1979 | Japan | 338/2 |

OTHER PUBLICATIONS

Information Sheet Entitled: "Locator TW-3000 Taut Wire Fence Alarm", Vindicator Corporation, 1445 Oakland Rd., San Jose, CA 95112-1203, U.S.A., Aug. 1985.

Omega 1987, Complete Pressure, Strain and Force, Measurement Handbook and Encyclopedia, Omega Engineering, Inc. pp. A10-A15, E-35-E-62.

*Primary Examiner*—Joseph A. Orsion, Jr.
*Assistant Examiner*—Annie H. Chau
*Attorney, Agent, or Firm*—Saidman, Sterne, Kessler & Goldstein

[57] ABSTRACT

In a taut wire type intrusion detection system, each parallel wire defining a section of security fence is tensioned between a pair of wire-supporting vertical anchor posts. Intermediate the anchor posts there is provided a row of regularly spaced vertical detector posts each presenting a plurality of individual sensors, each associated with one of the taut wires and operable to produce a sensor signal when the tension of the wires changes. With each detector post there is associated sensor signal processing means, operable to analyze the sensor signals produced by the sensors of the detector post in response to changes in tension of the taut wires, and to generate output signals correlatable with the sensor signals. Each sensor preferably includes a pressure transducer comprising a partially conductive compressible elastic sensing element whose resistance changes with applied pressure.

24 Claims, 7 Drawing Sheets

FIG.7.
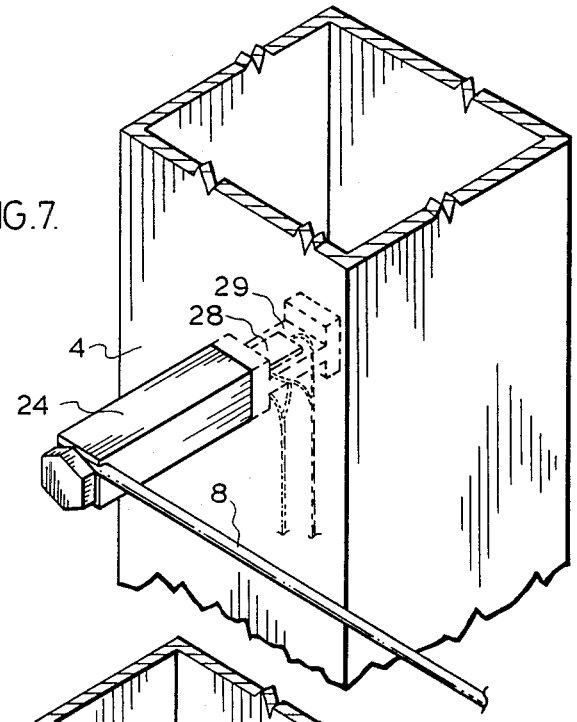
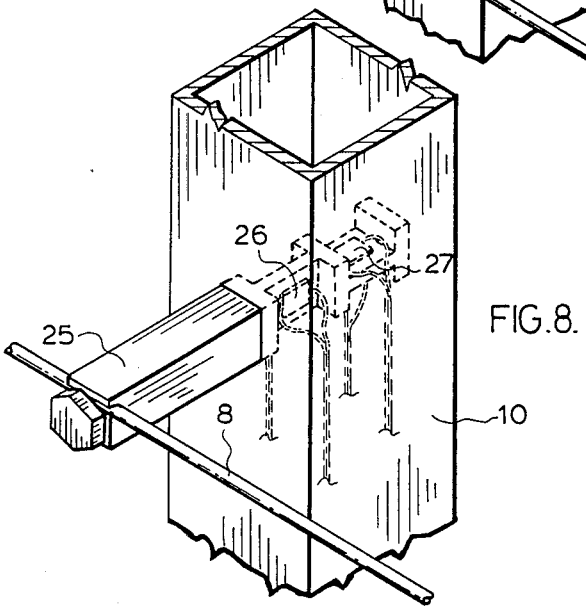
FIG.8.

TAUT WIRE INTRUSION DETECTION SYSTEM

RELATED APPLICATION

This application is a continuation-in-part of U.S. patent application Ser. No. 022,294 filed Mar. 3, 1987.

FIELD OF THE INVENTION

The present invention relates to an intrusion detection system of the kind comprising a barrier of taut wires and detector devices coupled to the wires for detecting intrusion attempts.

BACKGROUND OF THE INVENTION

In recent years a number of taut-wire intrusion detection systems of varying degrees of sophistication have been developed. Prior known wire fences typically include a detection zone consisting of two anchor posts to which a plurality of trip wires are secured and a centrally located sensor post. Such an arrangement presents the risk that an intruder using the taut wires as footholds very close to the point of attachment of wires to an anchor post may successfully climb such a fence without triggering an alarm, since the deflection of the wires from their normal position in the vicinity of the remote sensor post is then at a minimum compred with an intrusion at other locations along the fence. Increasing the sensitivity of the detectors in the sensor post in such a fence arrangement may lead to frequent false alarms.

Attempts have been made to lessen the risk of an intrusion in the "dead" vicinity of an anchor post by providing wire-anchoring members at regular intervals along the fence which are of a geometry or configuration that is more difficult to scale than a vertical anchor post. A ground-anchoring means comprising a diagonally secured post to which the trip wires are secured is illustrated in U.S. Pat. No. 4,533,906 (Amir). This and other arrangements, however, do not address the fundamental problem of the presence in a security fence of a plurality of wire-anchoring regions which are necessarily less sensitive to intrusion than regions remote from the anchoring of the wires, where an intrusion attempt will cause more substantial wire deflections.

A further disadvantage presented by prior fence alarm systems is their inability to distinguish between the numerous different kinds of intrusion events which can be presented and to distinguish these from each other and from non-intrusive events (false alarms) caused by changing environmental conditions, and the like. In particular, prior known taut-wire fence alarm systems have an arrangemenet of sensors on detector posts such that a detector post will go into an alarm condition once any or all of the trip-wires associated with the detector post is deflected by some pre-determined threshold amount. A greater sophistication of signal analysis is required to distinguish, for example, between attempts to penetrate the taut-wire barrier by climbing, an attempt to pass between the wires by spreading two of them apart, "false" signals caused by severe weather conditions, and so on.

BRIEF SUMMARY OF THE INVENTION

With a view to overcoming the aforesaid disadvantages of prior known taut wire fence alarm systems, and to providing a taut wire intrusion detection system operable to detect and identify intrusion events over a wide dynamic range, the present invention is in one of its embodiments directed to a security fence for detecting movement of an intruder past said fence, comprising a pair of wire-supporting vertical poles, a row of vertical detector posts spaced between said wire supporting poles, a plurality of individual sensors regularly spaced vertically along each of the detector posts, each of the sensors being operable to produce a sensor signal when subject to a change in lateral force applied thereto, and a plurality of taut wires each tensioned between said wire supporting poles and connected to one sensor on each of said detector posts. The security fence of the invention includes sensor signal processing means associated with each of the detector posts, operable to analyse the sensor signal produced by the sensors of the detector post in esponse to changes in tension in each of the taut wires, and to generate output signals correlatable with the sensor signals.

In a preferred embodiment, the signal processing means associated with each said detector post is located within the hollow interior of the detector post and includes means for measuring pre-selected characteristics of the sensor signals and for producing derivative signals correlatable therewith, and means for comparing said derivative signals to pre-selected reference signals and for generating an output signal correlatable with such comparison. Alternatively, a module containing the signal processing means may be mounted adjacent to or remote from its associated detector post.

In the presently preferred embodiment of the invention, each of the sensors associated with the detector post comprises a sensor bar and a pressure transducer comprising a sensing element made up of a material whose resistance changes with applied force and circuit means for producing an output signal correlatable with the resistance of the sensing element.

Further features and advantages of the invention will be apparent from the description below.

BRIEF DESCRIPTION OF THE DRAWINGS

The invention is described herein, by way of example only, with reference to the accompanying drawings, wherein:

FIG. 7 is a perspective view of a sensor comprising strain gauge means, as mounted in the configuration associated with a corner post or anchor post of the security fence.

FIG. 8 is a perspective view of a sensor according to an alternative embodiment of the invention.

DESCRIPTION OF THE PREFERRED EMBODIMENTS

Figure 1:
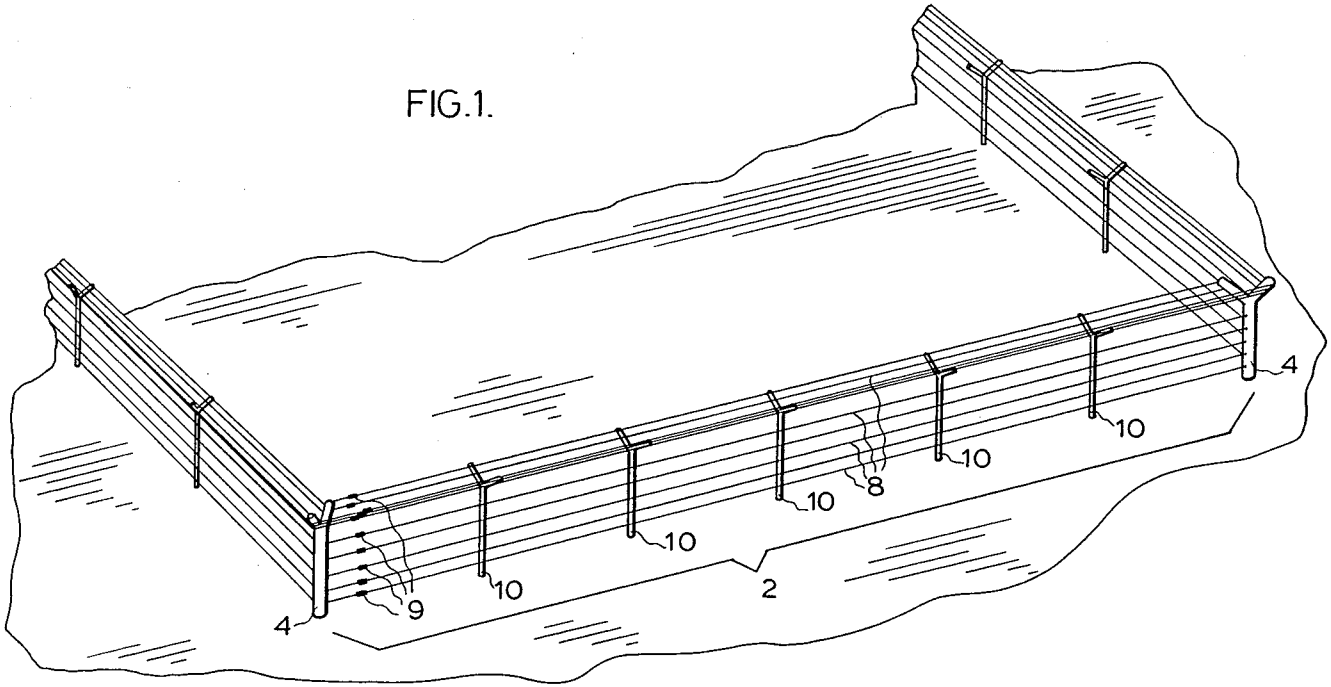
FIG. 1 is a perspective view of a security enclosure formed by sections of security fence according to the invention.
Figure 2:
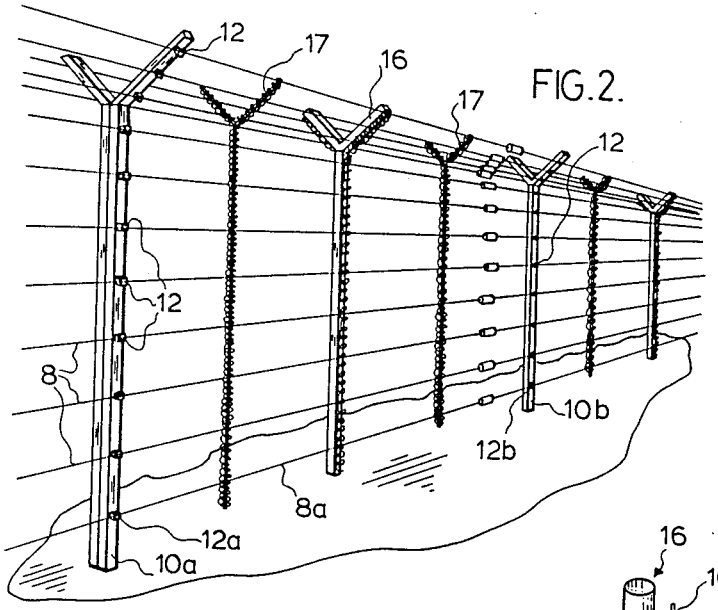
FIG. 2 is a perspective view, partly broken away, illustrating the components of a portion of the security fence according to a preferred embodiment of the invention.

The sequence of structural members in a section of security fence according to the invention is illustrated in FIGS. 1 and 2.

At opposite ends of a straight section of fence 2 are end to end anchor posts 4 between which a group of wires 8 are secured under tension. The wire tension is set to a desired initial level suitable for the ambient conditions which obtain but, typically around 35 Kg, by means of tensioning devices 9. Anchor posts 4 are typically separated by a relatively long distance, depending upon the size and geometry of the area to be secured and the topography of the terrain over which the section of fence is installed. On flat and regular terrain, a span of fence of length up to one mile or more may be installed between a single pair of anchor posts. As shown in FIG. 1, anchor posts 4 of fence section 2 appear at the corners of the fence, but it will be aparent for some applications, two or more sections 2 can be constructed in a line to form the side of an enclosure.

Spaced at regular intervals along the fence between the pair of anchor posts 4 are sensor-carrying detector posts 10. The separation between detector posts 10 is preferably about 160 feet. In FIG. 1, there are depicted only five detector posts 10 between anchor post 4, but it will be appreciated that there may be any elected number of such detector posts 10 between successive pairs of anchor posts depending upon the distance between anchor posts, the terrain and detection zone requirements. Located between the anchor posts in addition to the detector posts are intermediate vertical support members, (not shown in FIG. 1) which are described below in connection with the more detailed representations in FIG. 2.

Each detector post 10 supports a plurality of sensors 12. Each tensioned taut wire 8 operatively engages one sensor 12 on each detector post 10. Thus, as seen in FIG. 2, taut wire 8*a* extends between sensors 12*a* and 12*b* on detector post 10*a* and 10*b*, respectively. The number of taut wires and the spacing therebetween will vary, depending upon the nature of the area being secured. For some applications, taut wires spaced six inches apart might be appropriate, although it will be appreciated that the taut wire spacing need not be uniform.

Figure 3:
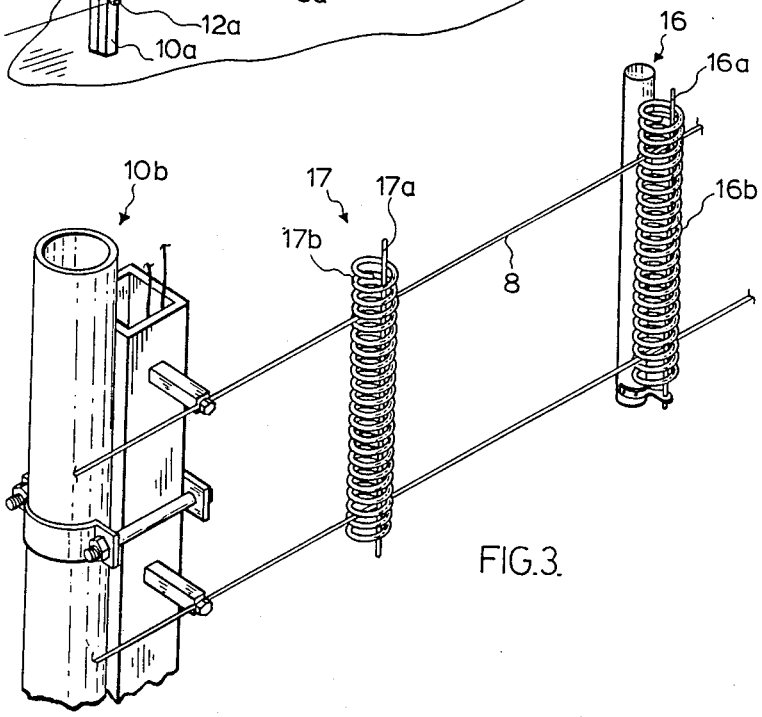
FIG. 3 illustrates details of the intermediate support members and support guides of the section of security fence shown in FIG. 2.

Between horizontally consecutive sensors such as 12*a* and 12*b*, a trip wire passes through helical support member 16 and helical support guides 17 shown in greater detail in FIG. 3.

In FIG. 3, a sensor-carrying detector post 10*b* and adjacent helical support guide 17 and support member 16 are illustrated. In support guide 17, taut wire 8 is retained within helical member 17*b* by a vertical rod 17*a* inserted into the coils of the helix in front of the taut wire. Similarly, in support members such as 16, the taut wire is retained within helical member 16*b* by vertical rod 16*a*.

Support members 16 maintain the taut wires in parallel relationship, while permittng free longitudinal movement of each wire whereby the sensors connected to that wire are triggered. Moreover, the presence of a plurality of additional shorter support guides 17 serves to increase the transmission to the sensors of forces generated by taut wires being spread apart, by increasing the longitudinal force component exerted at the sensors. In this connection, it should be noted that in FIG. 2 only a few of the slider posts and guiding posts present between a pair of successive detector posts 10*a* and 10*b* are shown. Typically, for a detector post-to-detector post separation of one hundred and sixty feet, support members 16 and support guides 17 will be alternately placed about every five feet between the sensor posts.

A particular preferred form of sensor for use in connection with the signal processing means of the invention is based upon the use of resistive strain gauges, and is described in more detail below. However, it will be appreciated that any of a number of multiple detector means connected to individual taut wires 8 so as to produce an electrical signal when one of the taut wires is displaced may be used in connection with the novel arrangement of post members and associated signal processing means according to the invention. For example, sensors 12 could be piezoelectric transducers which produce an electrical signal in response to the application of an external force.

As mentioned earlier, prior known wire fences capable of detecting intrusion attempts commonly include an alternating sequence of anchor post detector post anchor post detector post etc., so that an intruder may climb over the fence by stepping near to the point of attachment of wires to the anchor post. In a fence according to the present invention, the anchoring positions have effectively been moved to the ends of a section of fence. Consequently, an intrusive movement of one of the wires of the fence will trigger sensors on at least two detector posts, with attendant greater sensitivity than prior art arrangements in which an inert anchor post is positioned between each detector post.

Moreover, in prior known security fences such as U.S. Pat. No. 4,367,459 (Amir), a plurality of wires is coupled to a single detector so that it is not possible to differentiate between different kinds of intrusive events. By means of the arrangement of sensors and signal processing means according to the invention, schematically illustrated in FIG. 4, the signals from individual sensors may be evaluated and analysed to differentiate between intrusive events characterized by differing sequences of trip-wire motion.

Figure 4:
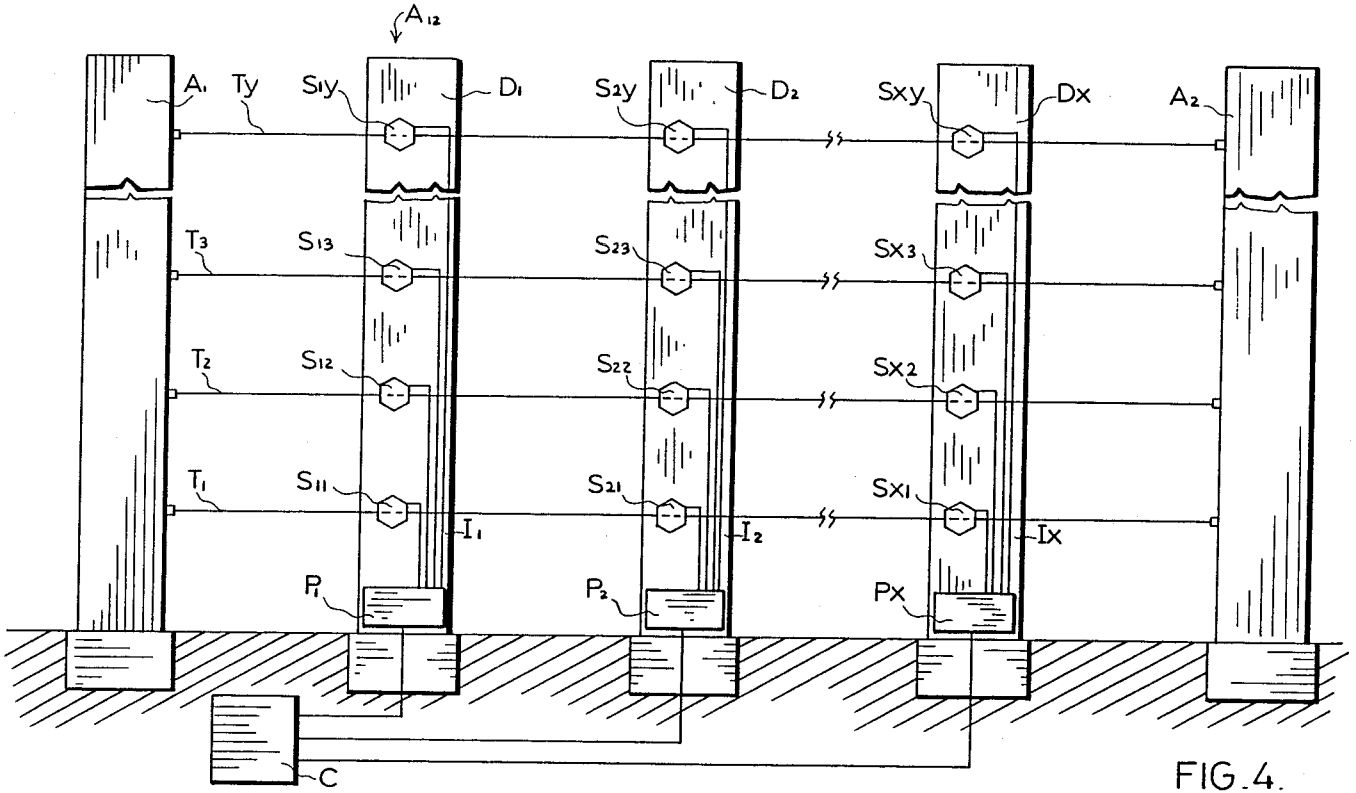
FIG. 4 is a schematic representation of the array of sensors and signal processing means and their operative relationship in a security fence according to the invention.

Referring now to FIG. 4, illustrating in schematic form a section $A_{12}$ of the security fence of the present invention, section $A_{12}$ comprises anchor posts $A_1$ and $A_2$ and a plurality of detector posts $D_1, D_2, \ldots D_x$ spaced therebetween. Taut wires $T_1, T_2, \ldots T_y$ are anchored to anchor posts $A_1$ and $A_2$ and extend therebetween, typically in a spaced, parallel relationship. A plurality of spaced sensors $S_{xy}$ are mounted on each detector post $D_x$ so as to be aligned with and connected to taut wires $T_y$. For example, sensors $S_{11}, S_{12}, \ldots S_{1y}$ are mounted on detector post $D_1$. Thus it will be apparent that the intersection of detector posts $D_x$ and taut wires $T_y$ at sensors $S_{xy}$ defines a matrix or rectangular array having columns $D_x$, rows $T_y$, and values $S_{xy}$.

Each sensor $S_{xy}$ detects a change in the lateral force applied thereto by taut wire $T_y$, and produces an output signal correlatable with such change in lateral force. The output signal of each sensor $S_{xy}$ is received by detector post processing means $P_x$ by means of sensorto-processing means interface $I_x$. For example, processing means $P_1$ of detector post $D_1$ receives the output of all of the sensors $S_{11}$, $S_{12}$, . . . $S_{1y}$ mounted on detector post $P_1$.

In a preferred embodiment, anchor posts $A_1$ and $A_2$ will include sensors which are operable to detect changes in vertical forces and produce ouput signals for processing. Such vertical movement-detecting anchor post or corner sensors are described below with reference to FIG. 7.

Each processing means $P_x$ analyses the signals generated by sensors $S_{xy}$ of a given detector post $D_x$ and generates an output signal correlatable therewith. The output signal of each processing means $P_x$ is received by central control unit C via a processor-to-control unit interface.

Processing means $P_x$ are preferably microprocessors. Typically, input from sensors $S_{xy}$ is converted from an analog to digital signal received by the microprocessor's data input means, stored in RAM (Random Access Memory), processed by the central processing unit, and outputted to the central control unit via data output means.

It will be appreciated that a microprocessor-based processing unit has a great deal of flexibility in terms of processing capability, but typically the microprocessor will include measuring and comparing means such as progrms residing in ROM (Read Only Memory) storage for determining and comparing the values of certain characteristics of the sensor signals with the values of selected reference variables. For example, the comparing means could include means for determining the values of the timing, duration and amplitude of the signals generated by sensors $S_{xy}$, and means for determining if these values fall within a pre-selected range of values. If the values fall outside the pre-selected range, the processing means $P_x$ generates an output signal representing an alarm condition. Such output alarm signal would preferably include the address of the particular sensor causing the alarm condition, so that the operator of the central control unit would know exactly which sensor on a particular detector post had been triggered. The reference variables and the values thereof should be selected to achieve a desirable level of sensitivity—a level which is high enough to ignore signals caused by changes in ambient conditions and other non-intrusive activity, but low enough to detect all intrusive activity.

In a preferred embodiment, each processing means $P_x$ include means for correlating input received from all of the individual sensors $S_{xy}$ on a particular detector post $D_x$ and for generating an output signal which is dependent upon the input received from such sensors. Thus each processing means $P_x$ of this preferred embodiment is operable to identify various types of intrusive activity occurring near a particular detector post $D_x$. For example, consecutive triggering of sensors $S_{12}$, $S_{14}$, $S_{16}$, $S_{18}$, . . . might be indicative of an intruder climbing the fence near detector post $D_1$, by stepping on every second taut wire, whereas simultaneous triggering of two adjacent sensors might represent an intruder separatingg adjacent taut wires.

For some applications, the central control unit may be no more than a dumb terminal which receives, stores and displays the output of the post processors. Such terminal may include an alarm device such as a bell and/or buzzer which is activated upon an alarm condition being generated by one of the post processors. Information available to the operator would typically include the address of the detector post $D_x$ which generated the alarm condition and preferably the address of the individual sensor(s) $S_{xy}$ causing the alarm signal.

However, in a preferred embodiment, the central control unit is an intelligent processing unit including means for processing further and correlating the signals received from the various processing means $P_x$ and means for generating a variety of different alarm conditions based upon such correlation. Thus, the central control unit could be set up to discriminate between, identify, and localize a variety of different types of intrusions occurring anywhere along the fence, by analysing the signals received from the matrix of sensors $S_{xy}$. For example, a correlation of high amplitude signals of relatively short duration received from simultaneously activated sensor $S_{13}$ on detector post $P_1$ and sensor $S_{23}$ on detector post $P_2$ would normally be indicative of a type of intrusion which is entirely different from that based upon a correlation of low amplitude signals of relatively long duration received from a number of activated sensors on several detector posts. Use of a central processing unit capable of receiving, processing and correlating discrete signals from a matrix of sensors $S_{xy}$ provides this embodiment of the invention with information gathering and processing power which has been heretofore unavailable on taut wire fence security systems.

As indicated earlier, it is apparent that any of a number of different kinds of sensors could be used in the fence-alarm system of the present invention.

Figure 5:
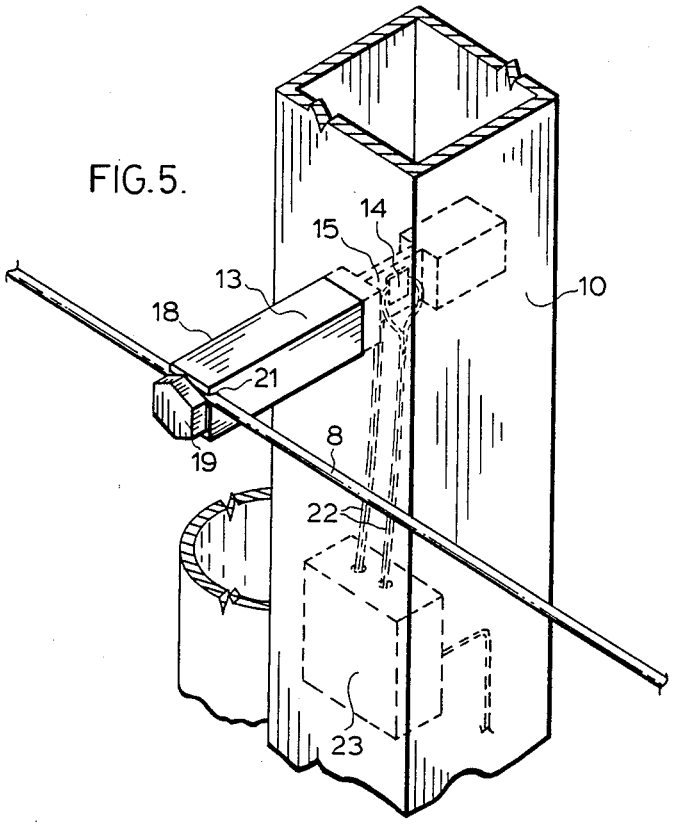
FIG. 5 is a perspective view of a detector post in a security fence according to the invention, showing the installation of a particular sensor comprising strain gauge means according to a preferred embodiment of the invention.
Figure 6:
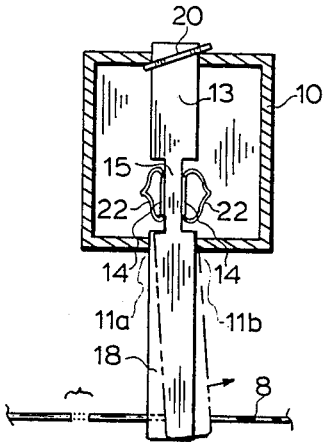
FIG. 6 is a sectional view along lines A—A of FIG. 5.

A preferred embodiment of sensor based upon the use of resistive strain gauges is illustrated in FIGS. 5 and 6. Steel sensor bar 13 is installed through apertures in the front and rear faces of hollow detector post 10. The rear end of sensor bar 13 is firmly held within the rear aperture on detector post 10 by roll pin 20, as best seen in FIG. 6. Sensor bar 13 presents a narrowed rectangular cross section along a mid-portion 15 which is located entirely within the interior of detector post 10 when sensor bar 13 is installed in the detector post. On opposite faces of mid-portion 15, strain gauges 14 are adhesively attached. A constant voltage is applied to each of the two strain-gauges by leads 22, and the current flow through each is monitored. For strain gauges of this kind, the resistance changes when gauge is distorted. Thus a distortion of the gauge causes a change in current flow through strain gauges 14 and leads 22. The current flow through leads 22 is the sensor signal, which is monitored by processing means 23. It is emphasized that while the use of an opposed pair of strain gauges is preferred, a sensor bar incorporating one or more such resistive strain gauges might be used in the invention. The use of an opposed pair of gauges permits their installation in a relative rotation orientation tending to minimize electromagnetic interference.

As seen in FIGS. 5 and 6, the front portion 18 of sensor bar 13 is secured to taut wire 8 by adjustable screw 19, which bears against taut wire 8 in outwardly open recess 21. A change in the tension of wire 8, as when the wire is pulled laterally, results in lateral motion of 18 and a slight bending of portion 15. The extent of lateral motion of 18 is limited by the sides 11*a* and 11*b* of the front apertures through detector post 10. Bending of portion 15 gives rise to the aforementioned sensor signal.

Preferably, in the installation of a security fence in which the sensors are sensor bars of the kind just described, a small pre-loading bias will be applied to each such sensor bar by urging the front portion 18 to one side before tightening lock nut 19 onto wire 8 in recess 21. In this way, the base (reference) current through strain gauges 14 will correspond to a pre-loaded state of sensor bar 13. An attempt at intrusion by cutting taut wire 8 or tampering with nut 19 will then result in an immediate change in resistance and cause a sensor signal response, when the sensor bar springs back to its rest position.

A further feature of the aforementioned flexibility of the microprocessor-based processing unit employed in the system of the present invention is that the programming may include the capability of resetting the reference zero (non-signal condition) for the various detector post sensor signals. This avoids the requirement for corrective maintenance, since the microprocessor is apprised of new static conditions of strain in each of the sensors in a detector post following every routine check of the field processors in the detector posts.

In a preferred embodiment, illustrated in FIG. 7, the taut wires are anchored to the anchor posts 4 by means of a plurality of anchoring sensing members 24, which not only hold taut wires 8 under tension, but also act as sensors to detect vertical displacements of the taut wires in the vicinity of the anchor posts. The bodies of such anchoring/sensing members must be relatively rigid laterally, but relatively flexible vertically. Anchoring/sensing member 24 has a narrow mid-portion 29 to which are adhesively affixed vertically extending strain gauges 28. The use of anchoring means susceptible to vertical defection enables the system to detect certain events occurring at the anchor posts, such as an intruder climbing an anchor post.

An alternative embodiment of the sensor bar is shown in FIG. 8. Sensor bar 25 includes two pairs of strain gauges, lateral pair 26 for detecting lateral distortions and vertical pair 27 for detecting vertical distortions. Sensor bar 25 is operable to detect both vertical and lateral deflections of taut wire 8.

Figure 9:
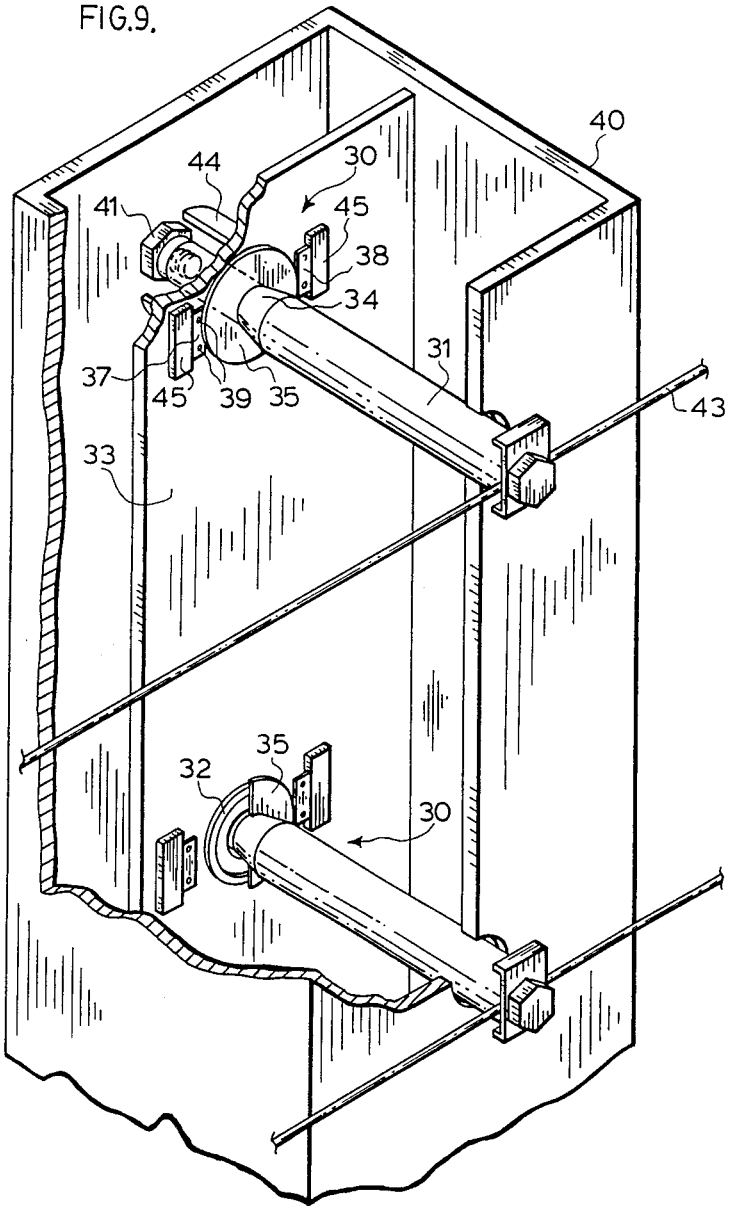
FIG. 9 is a cut-away perspective view of the sensor of the presently preferred embodiment of the invention.

The sensors of the presently preferred embodiment of the invention are illustrated in FIG. 9. Preferred sensor 30 comprises sensor bar 31 mounted to the back surface of detector post 40 in a cantilevered fashion by bolt 41, pressure sensing elements 37, 38 mounted on the front of PC Board 33 which is attached to the back of detector post 40 by spacer 44, and associated circuit means (not shown) mounted on the back of PC Board 33. Sensor bar 31, which is preferrably of round cross-section having a tapered portion 34, extends through an aperture in the front face of detector post 40 and through an aperture in PC Board 33. Rigid washer 35, preferably of round periphery, is fitted onto tapered portion 34 of sensor bar 31, so that rigid washer 35 moves in conjunction with sensor bar 31. Flexible isolation washer 32 surrounds sensor bar 31 and is located between rigid washer 35 and PC Board 33, in order to isolate the movement of sensor bar 31 and rigid washer 35 from PC Board 33. Each of sensing elements 37, 38 are secured to PC Board 33 adjacent rigid washer 35 by means of a pair of electrodes 39. Backing boards 45 are mounted on PC Board 33 behind each of sensing elements 37, 38. Preferably, sensing element 37 is mounted to the left of sensor bar 31, and sensing element 38 is mounted to the right of sensor bar 31. In a preferred form of the invention, sensing elements 37, 38 are positioned relative to rigid washer 35 so that they are compressed slightly by rigid washer 35 when sensor bar 31 is mounted to detector post 40, even before any tension is applied to sensor bar 31 by trip wire 43, for reasons discussed below.

Sensing elements 37, 38 have the following characteristics: (1) they are compressible and elastic; (2) they are partically conductive, i.e. their electrical conductivity is intermediate between that of a conductor and that of an insulator; and (3) their resistance varies with applied pressure. Sensing elements 37, 38 preferably comprise a composite material made up of a non-conductive compressible elastic rubber or rubber-like material impregnated with a conductive particulate material such as carbon or silver. This sort of material forms a non-crystalline matrix of conductive particles embedded in a compressible elastic non-conductive medium. A composite material found to be suitable for sensing elements 37, 38 is a silicone rubber having carbon powder embedded therein, although other elastomerics impregnated with other types of metal powders can be used.

It has been found that when the above-described composite material is subjected to compressive or shear forces, the material is deformed, resulting in a change in the resistance of the material. In the case of most of the sensing element materials tested to date, the resistance of the material decreases exponentially when the material is compressed, until its elastic limit is reached. It is believed by the inventors that this decrease in resistance is caused by the embedded conductive particles being moved closer together, upon the material being depressed. However, it has been found that in some of the composite materials tested, their resistance increases with an increase in applied pressure.

Figure 10:
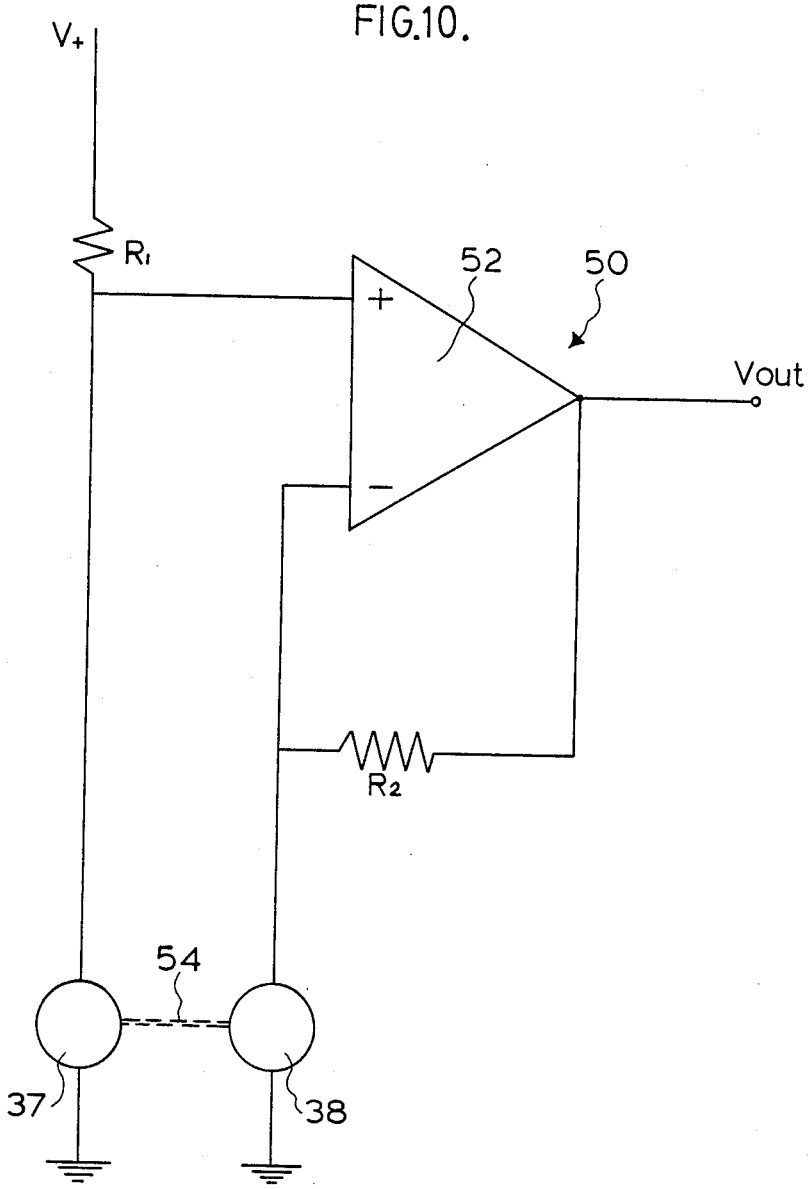
FIG. 10 is a circuit diagram of a pre-amplifier circuit for the sensor shown in FIG. 9.

FIG. 10 illustrates a preferred preamplifier circuit for preferred sensor 30. Preamplifier circuit 50 comprises operational amplifier 52, resistors R1 and R2, sensing elements 37 and 38, and a mechanical linkage 54. In the preferred embodiment, mechanical linkage 54 comprises sensor bar 31, rigid washer 35 and isolation washer 32. It will be appreciated that if a compressive pre-load force is placed on sensing elements 37, 38 by sensor bar 31 and rigid washer 35, when sensor bar 31 is flexed to one side or the other as a result of a change in lateral tension of trip wire 43, one of sensing elements 37, 38 will be compressed further, while the other will be taken out of compression to some degree.

One of the electrodes of each of sensing elements 37, 38 is grounded. The other electrode of sensing element 37 is grounded to the non-inverting input of operational amplifier 52, while the other electrode of sensing element 38 is coupled to the inverting input of operational amplifier 52. A constant voltage is applied to the non-inverting input of operational amplifier 52 through resistor R1, by a suitable power supply. Resistor R2, which is connected between the output and the inverting input terminal of operational amplifier 52, and sensing element 24, together make up a negative feedback loop which controls the gain of amplifier 52.

Sensing element 37 controls the input voltage of operational amplifier 52 and sensing element 38 controls the gain of operational amplifier 52. If the resistance of sensing element 38 is increased, and the resistance of sensing element 37 is decreased, as a result of a change in lateral tension of trip wire 43 causing sensor bar 31 to pivot towards sensing element 38, both the input signal and the gain of operational amplifier 52 will be simultaneously increased, resulting in an increase in the output voltage of circuit 50. Similarly, the output voltage of circuit 50 will decrease if sensor element 37 is compressed and sensor element 38 is decompressed. Accordingly, preferred sensor 30 is capable of detecting the direction of a change in the lateral tension of taut wire 43. Sensor 30 can also detect vertical movement of sensor bar 31, such as that resulting from an intruder using sensor bar 31 as a foothold, because vertical movement of sensor bar 31 will produce shear forces on sensing elements 37, 38, which change their resistance. However, in order to differentiate between up or down movement of sensor bar 31, it would be necessary to mount additional sensing elements at the top and bottom of rigid washer 35.

If R1 and R2 are of the same value and if sensing elements 37 and 38 are of the same physical size and shape, the resistance of sensing elements 37, 38 will be equal when they are placed under the same amount of compressive stress. Any ambient forces such as temperature changes that act on both sensing elements in equal fashion will result in little or no change of the output voltage of the operational amplifier, because an increase in input voltage caused by an increase in the resistance of sensing elements 37 would be accompanied by a compensating decrease in amplifier gain caused by a decrease in resistance of sensing elements. Therefore, the circuit shown in FIG. 10 provides for inherent temperature compensation.

Preferred sensor 30 is believed by the inventors to have a number of advantages over sensors utilizing conventional strain gauges. Conventional strain gauges of the wire resistance type utilizing a coil of fine wire are not very sensitive, since its change in resistance per unit of applied force is low. As a result, the signal from a wire resistance strain gauge must be amplified by several orders of magnitude, in order to get a usable signal. In contrast, the change in resistance of the sensing material of the preferred sensor of the present invention tends to be rather large, resulting in a signal having a large signal-to-noise ratio and requiring little or no amplification.

It will be apparent that there are various alternative embodiments of preferred sensor 30. For applications not requiring a differentiation between left and right displacements of the taut wire, a single pressure transducer could be utilized. For example, the sensor bar could be mounted on top of an annulus of the above-described partially conductive compressible elastic sensing material secured to a PC board, so that flexing of the sensor bar would cause a shear force to be imparted to the partially conductive elastic material, thus changing its resistance.

While the invention has been described with respect to certain preferred and alternative embodiments, it will be appreciated that any other variations and applications may be made. Accordingly, it will be apparent to those skilled in the art that various modifications and adaptions of the structure as described above are possible without departing from the spirit of this invention, the scope of which is defined in the appended claims.

We claim:

1. A section of a security fence for detecting movement of an intruder past said fence, comprising:

a pair of wire-supporting vertical anchor posts;

a row of vertical detector posts spaced between said wire-supporting anchor posts comprising a plurality of detector posts;

a plurality of individual sensors spaced vertically along each of said detector posts, each of said sensors being operable to produce a sensor signal when said sensor is subjected to a change in force applied thereto;

a plurality of trip wires, each tensioned between said wire-supporting anchor posts and connected to a plurality of said sensors on said detector posts;

a plurality of anchor sensing means extending from the anchor posts for anchoring the plurality of trip wires to the anchor posts under tension and for producing a sensor signal when the anchor sensing means is subjected to a change in force applied thereto; and sensor signal processing means associated with said detector posts for analysing the sensor signals produced by sensors of said detector posts in response to changes in tension of said trip wires, and for generating output signals correlatable with the sensor signals.

2. A security fence section as defined in claim 1, further comprising a plurality of intermediate support members operable to loosely engage said wires to maintain a selected vertical spacing therebetween and to translate a force normal to a wire into a lateral motion of said wire and a corresponding change in lateral force exerted on the sensors connected to the ends of said wire.

3. A security fence section according to claim 1, wherein said sensors each comprise a pressure transducer comprising a partially conductive compressible elastic sensing element whose resistance changes with applied pressure.

4. A security fence according to claim 1, wherein each of said sensors is a tension detector, comprising:

a flexible bar having adhesively mounted thereon one or more resistive strain gauges, operable so that a reference current through said strain gauges arising from a constant applied voltage is changed when said bar is flexed by changes in tension of the wire attached to said flexible bar.

5. A security fence section as defined in claim 3, wherein the sensing element of the sensors comprises a composite material comprising a non-compressible elastic material impregnated with a conductive particulate material.

6. A security fence section as defined in claim 5, wherein the sensors also comprise a sensor bar mounted to the detector post operable to apply a force to the sensing element which is correlatable with the tension of the trip wire attached to the sensor bar.

7. A security fence section according to claim 1, wherein the anchor means are operable to anchor the wires under relatively high pre-load lateral tension nd also operable to produce a signal when the wire anchored thereto is subjected to a relatively small increase in lateral tension.

8. A security fence section as defined in claim 1, wherein the detector posts have a hollow interior, a rear face and a front face having an aperture therein, and wherein the anchor sensing means comprises a sensor bar dimensioned to fit through the aperture in the front face and having a back end mounted to the rear face of the detector post in a cantilevered fashion, a front end having securing means for securing thereto a trip wire, and a middle section which is restrained by the front face of the detector post so as to enable the sensor bar to withstand relatively high lateral loading.

9. A security fence section as defined in claim 1, wherein the signal processing means includes measuring means for measuring pre-selected characteristics of the sensor signals and for producing derivative signals correletable therewith, and comparing means for making a comparison between said derivative signals and preselected reference signals and for generating an output signal correletable with said comparison.

10. A security fence section as defined in claim 9, wherein the signal processing means associated with each said detector post comprises a microprocessor for receiving and independently processing the signals of each individial sensor associated with said detector post and for generating an output signal for each of the individual sensors which includes an address value specific to an individual sensor and at least one data value correletable with a signal generated by said individual sensor.

11. A security fence section as defined in claim 10, wherein each said microprocessor is operable to compare the number, duration and order of appearance of sensor signals within a single detection post with a predetermined set of reference signal values, and to produce an alarm signal for said detector post of the actual pattern of sensor signals compares within pre-selected limits to said set of reference signal values.

12. A security fence section as described in claim 10, further comprising a central control monitoring unit operable for receiving the output signals of each of said signal processing means.

13. A security fence section as described in claim 12, wherein said central control monitoring unit is operable to display the computer address of every sensor involved in said alarm signal.

14. A security fence section as described in claim 12, wherein the central control monitoring unit is an intelligent central unit coupled to each of the signal processing units for receiving and correlating the output signals thereof, and for generating a plurality of discrete alarm conditions based upon such correlation.

15. A taut wire sensor adapted to be mounted on a detector post of a taut wire security fence including a row of spaced detector posts and a plurality of tensioned trip wires so as to detect a change in tension of a trip wire attached to the sensor, comprising:

pressure sensing means for sensing a change in applied pressure, comprising a partially conductive compressible elastic sensing element whose resistance decreases with applied pressure;

circuit means operatively coupled to the sensing element for generating an electrical output signal correlatable with the resistance of the sensing element; and mechanical means operatively coupled to the sensing element for applying thereto a pressure which is correlatable with the tension of the trip wire attached to the sensor.

16. A sensor as defined in claim 15, wherein the mechanical means is a sensor bar adapted to be mounted to the detector post in a cantilevered fashion.

17. A sensor as defined in claim 15, wherein the sensing element comprises a composite material comprising a non-conductive compressible elastic material impregnated with a particulate conductive material.

18. A pressure sensor as defined in claim 17, wherein the non-conductive material is a silicone rubber and the conductive particulate material is a metal powder.

19. A sensor as defined in claim 15, wherein the pressure sensing means comprises a pair of sensing elements, each of which is made up of a partially conductive compressible elastic sensing material whose resistance changes with applied pressure.

20. A pressure sensor as defined in claim 19, wherein the mechanical means for applying pressure to the sensing means comprises a mechanical linkage operatively coupled to each of the pair of sensing elements operable to compress one of the sensing elements while simultaneously taking the other of the sensing elements out of compression in response to a force applied to the mechanical linkage.

21. A sensor as defined in claim 20, wherein the circuit means comprises an operational amplifier, wherein one of the sensing elements controls the input voltage to the operational amplifier and the other of the sensing elements controls the gain of the operational amplifier.

22. A sensor as defined in claim 19, wherein one of the sensing elements is mounted to the left of the mechanical linkage and the other of the sensing elements is mounted to the right of the mechanical linkage, so that the sensor can determine the direction of change in the lateral tension of the trip wire.

23. A sensor as defined in claim 19, wherein the mechanical linkage comprises a sensor bar mounted to the detector post in a cantilevered fashion, and a rigid washer coupled to the sensor bar having a periphery which bears against each of the pair of sensing elements.

24. A sensor as defined in claim 23, wherein the sensing material is a composite material comprising a non-conductive compressible elastic material impregnated with a conductive particulate material.

* * * * *